US009414729B2

(12) United States Patent
Zydek

(10) Patent No.: US 9,414,729 B2
(45) Date of Patent: Aug. 16, 2016

(54) ROBOTIC VACUUM CLEANER HAVING A MULTIPLE ARRANGEMENT OF SIDE BRUSHES

(71) Applicant: WESSEL-WERK GMBH, Reichshof-Wildbergerhuette (DE)

(72) Inventor: Martin Zydek, Drolschagen (DE)

(73) Assignee: WESSEL-WERK GMBH, Reichshof-Wildbergerhuette (DE)

( * ) Notice: Subject to any disclaimer, the term of this patent is extended or adjusted under 35 U.S.C. 154(b) by 0 days.

(21) Appl. No.: 14/725,020

(22) Filed: May 29, 2015

(65) Prior Publication Data

US 2015/0342431 A1 Dec. 3, 2015

(30) Foreign Application Priority Data

May 30, 2014 (DE) ..... 10 2014 007 747
Feb. 4, 2015 (DE) ..... 10 2015 101 587

(51) Int. Cl.
*A47L 9/04* (2006.01)
*A47L 11/40* (2006.01)

(52) U.S. Cl.
CPC ..... *A47L 9/0488* (2013.01); *A47L 9/0472* (2013.01); *A47L 9/0477* (2013.01); *A47L 11/4038* (2013.01); *A47L 11/4041* (2013.01); *A47L 2201/00* (2013.01)

(58) Field of Classification Search
CPC ... A47L 9/0488; A47L 9/0472; A47L 9/0477; A47L 11/4038; A47L 11/4041; A47L 2201/00
See application file for complete search history.

(56) References Cited

U.S. PATENT DOCUMENTS

| | | | | |
|---|---|---|---|---|
| 8,505,158 | B2 * | 8/2013 | Han | A47L 7/02 15/347 |
| 8,776,308 | B2 | 7/2014 | Jung et al. | |
| 9,078,552 | B2 * | 7/2015 | Han | A47L 9/00 |
| 2006/0236492 | A1 * | 10/2006 | Sudo | A47L 11/24 15/319 |
| 2011/0239382 | A1 * | 10/2011 | Lee | A47L 9/009 15/3 |
| 2013/0025085 | A1 | 1/2013 | Kim et al. | |
| 2015/0182087 | A1 * | 7/2015 | Gerth | A47L 9/2805 15/319 |

FOREIGN PATENT DOCUMENTS

| | | |
|---|---|---|
| DE | 10242257 | 4/2003 |
| EP | 2422675 | 2/2012 |
| KR | 1020070066146 | 6/2007 |

* cited by examiner

*Primary Examiner* — Dung Van Nguyen
(74) *Attorney, Agent, or Firm* — Michael J. Striker

(57) ABSTRACT

A robotic vacuum cleaner includes a driving mechanism, a fan, an electronic control, sweeping brushes and a housing with a front side extending in the transverse direction (q) and a longitudinal direction (l) perpendicular thereto. An underside of the housing has a suction opening that extends in the transverse direction (q). At least four sweeping brushes are provided, where at least two of the four sweeping brushes are disposed on each side of the suction opening such that at least one subregion of the suction opening remains free from sweeping brushes, as viewed from the front side. The at least two of the four sweeping brushes provided on each of the two sides of the suction opening are driven in an identical direction of rotation.

10 Claims, 5 Drawing Sheets

ROBOTIC VACUUM CLEANER HAVING A MULTIPLE ARRANGEMENT OF SIDE BRUSHES

CROSS-REFERENCE TO A RELATED APPLICATION

The invention described and claimed hereinbelow is also described in German Patent Application DE 10 2014 007 747.0, filed on May 30, 2014, and in German Patent Application DE 10 2015 101 587.0, filed on Feb. 4, 2015. The German Patent Applications, the subject matters of which are incorporated herein by reference, provide the basis for a claim of priority of invention under 35 U.S.C. 119(a)-(d).

BACKGROUND OF THE INVENTION

The present invention relates to a robotic vacuum cleaner comprising a driving mechanism, a fan, an electronic control, an energy source, sweeping brushes, and a housing, which has a front side extending in a transverse direction and has a longitudinal direction perpendicular thereto. The underside of the housing has a suction opening, which extends in the transverse direction.

Specifically, the invention relates to a robotic vacuum cleaner having at least four sweeping brushes, which are disposed such that at least two sweeping brushes are provided on each side of the suction opening, wherein, as viewed from the front side, at least one subregion of the suction opening remains free from brushes.

Robotic vacuum cleaners of this type are used for the automatic cleaning of flat surfaces, for example floors. Energy is supplied, in this case, by an internal energy source, usually by built-in rechargeable batteries. The quantity of energy that is available between two charging processes is therefore limited, and therefore the use of the energy quantity by the various elements of the robotic vacuum cleaner is an important design criterion.

Robotic vacuum cleaners often comprise sweeping brushes, which are disposed in the transverse direction, laterally relative to the suction opening. The purpose of these sweeping brushes is to pick up laterally-located dirt in the edge region, over which the suction opening cannot be moved, e.g., on walls.

Document DE 102 42 257 B4 discloses a robotic vacuum cleaner comprising an electric drive, a container for collecting dirt, and a housing. The basic outline of the housing is composed of a circular section and a rectangular section. The rectangular section is disposed in the front, in the direction of motion. In addition, two sweeping brushes are provided in the front, rectangular section of the underside, which are intended to pick up dirt from the edge regions.

Document U.S. 2013/025 085A1 describes another robotic vacuum cleaner comprising a housing, a driving mechanism, which is formed from a motor and two wheels disposed at the sides as viewed in the transverse direction, a container for accommodating the collected dirt, a suction opening, and sensors. In addition, sweeping brushes for this robotic vacuum cleaner are provided on a vertical axis of rotation.

Another robotic vacuum cleaner is disclosed in EP 2 422 675 A2. The robotic vacuum cleaner described therein comprises a housing, a driving mechanism and sweeping brushes. The robotic vacuum cleaner also comprises contact sensors and/or proximity sensors.

A robotic vacuum cleaner of the type in question having a total of four sweeping brushes is disclosed in KR 10 2007 0066 146 A. Two sweeping brushes are disposed, as a pair in each case, in the transverse direction on each side of the suction opening. The two interacting sweeping brushes rotate in opposing directions, in each case, such that a type of intake gap is formed between the sweeping brushes, through which dirt is transported in the direction of the suction opening. The oppositely rotating sweeping brushes prevent dirt particles from being slung off, which would prevent these from being collected.

Document KR 10 2007 0066 146 A therefore relates to a detained improvement of a conventional robotic vacuum cleaner having one sweeping brush on each side of the suction opening, whereby a comparable function is achieved. A connecting line between the axes of rotation of the sweeping brushes assigned to one another extends approximately tangentially to the housing of the robotic vacuum cleaner. As viewed in the transverse direction, the two sweeping brushes assigned to one another overlap by approximately 50% relative to the diameter thereof.

SUMMARY OF THE INVENTION

The present invention overcomes the shortcomings of known arts, such as those mentioned above.

To that end, the present invention provides a robotic vacuum cleaner with improved cleaning efficiency.

In an embodiment, the robotic vacuum cleaner comprises driving mechanism, a fan, an electronic control, sweeping brushes and a housing. The housing has a front side extending in a transverse direction (q) and has a longitudinal direction (l) perpendicular thereto. An underside of the housing has a suction opening, which extends in the transverse direction (q). At least four sweeping brushes are disposed such that at least two sweeping brushes are provided on each side of the suction opening and at least one subregion of the suction opening remains free from sweeping brushes, as viewed from the front side.

The two sweeping brushes provided on each of the two sides of the suction opening can be driven in an identical direction of rotation on both sides of the suction opening and, on both sides of the suction opening, a connecting line between the axes of rotation of the two sweeping brushes disposed there in succession points in the direction of the suction opening.

By this arrangement of the sweeping brushes, dirt is additionally pushed by the at least four sweeping brushes, which are disposed in the transverse direction and laterally relative to the suction opening, in the direction of the suction opening and, therefore, into the region that is covered by an intake air flow generated by the fan. As a result, dirt is collected not only in front of the suction opening, as viewed in the direction of movement, but also in front of the sweeping brushes, as viewed in the direction of movement, since the sweeping brushes transport the dirt in the direction of the suction opening and thereby make the dirt accessible to the intake air flow. The robotic vacuum cleaner according to the invention collects dirt in the direction of movement both along the suction opening and along the sweeping brushes, therefore. Along the transport direction of the dirt in the region of the sweeping brushes, a decisive factor is that the respective at least two sweeping brushes, which are disposed in direct succession, have the same direction of rotation. As viewed from a front side, the sweeping brushes therefore rotate, at the front edges thereof, in the direction of the suction opening, i.e., inwardly, in order to convey the dirt inwardly by the rotational s movement.

In an embodiment, for example, having two sweeping brushes on each side of the suction opening, when dirt is captured at an outer edge of the robotic vacuum cleaner by the outermost sweeping brush there, the dirt is initially pushed further inward, in front of the sweeping brushes disposed closer to the suction opening and finally, from there, even further inward in front of the suction opening.

The sweeping brushes are disposed laterally relative to the suction opening, as viewed from the front, wherein an overlap with the suction opening is also possible and preferable. Particularly preferably, sweeping brushes extend from the suction opening up to the edge of the housing, thereby enabling a cleaning effect along the entire transverse side of the housing.

It also is conceivable that the outer sweeping brushes extend beyond the edge of the housing, and therefore the region captured by the sweeping brushes extends even beyond the width of the housing. For that matter, the extension of regions that are captured by sweeping brushes and/or by the suction opening are varied or coordinated with one another.

On both sides of the suction opening, a connecting line between the axes of rotation of the two sweeping brushes disposed there in succession points in the direction of the suction opening. The connecting line is approximately equivalent to the direction of the transport of dirt from the outside to the inside. In order to ensure that a connecting line pointing in the direction of the suction opening results, the two sweeping brushes can have an approximately identical position relative to the longitudinal direction.

Preferably, the sweeping brush located inwardly relative to the suction opening is offset toward the rear relative to the directly adjacent, outer sweeping brush. Such arrangement ensures that dirt pushed by the outer sweeping brush in front of the inner sweeping brush is accommodated in the front region and is then reliably transported to the suction opening.

An inventive embodiment also provides that the connecting line on both sides of the suction opening is disposed at an angle $\alpha$ between 5° and 30° relative to the transverse direction, as viewed from above. Reliable transport of dirt to the suction opening is achieved specifically in the indicated angular range. If more than two sweeping brushes are disposed on at least one side of the suction opening, all the sweeping brushes are disposed along the connecting line, although this embodiment is not absolutely necessary. If two spaced-apart suction openings are provided, as explained in the following, the sweeping brushes thereof can be disposed in the shape of a "W", for example. Expediently, the sweeping brushes interacting on each side of the suction opening are disposed such that these overlap at least slightly in the transverse direction. Otherwise, there would be a risk that, during a forward movement of the robotic vacuum cleaner, regions that are not reliably cleaned would remain between the mutually assigned sweeping brushes. On the other hand, excessive overlap should be avoided, because this reduces the surface area to be cleaned by the sweeping brushes during a typical forward movement. In an embodiment, the sweeping brushes therefore have one diameter in the plane formed by the longitudinal and transverse directions, wherein sweeping brushes that are directly adjacent to one another have an overlap in the transverse direction that is between 0.01 and 0.3 of the diameter. If the two mutually adjacent sweeping brushes have different diameters, the predefined values are preferably met for both diameters. Given that the dirt in the subregion in which sweeping brushes are disposed is loosened by the sweeping brushes and is pushed in the direction of the suction opening, as viewed from the front, the width of the suction opening can be selected to be correspondingly small. The suction opening preferably extends across less than half the entire width of the housing. In this context, the energy demand of the fan depends largely on the opening surface area, i.e., the length as well as the width of the suction opening. The smaller the width and/or length of the suction opening can be selected to be, the less energy required to generate a sufficient intake air flow. A small width of the suction opening is therefore advantageous for efficient use of the energy.

The sweeping brushes are disposed ahead of the suction opening in the longitudinal direction, thereby enabling the dirt located in front of the robotic vacuum cleaner to be swept into the effective region of the intake air flow and ultimately collected.

The sweeping brushes are mounted on axes extending vertically or obliquely, wherein bristles of the sweeping brushes are preferably disposed at an angle $\alpha$ such that the bristles come into contact with the floor. As an alternative, when the axis of the sweeping brushes extends obliquely, it also is possible that the bristles touch the floor only in a first subregion, wherein the bristles of a second subregion are raised off of the floor. This has the advantage that the bristles in the first subregion can penetrate the floor particularly deeply, while the bristles of the second subregion reduce friction, since they are raised. In addition, it is thereby possible for the bristles of a sweeping brush to sweep only in a preferred direction, i.e., only in the direction of the suction opening, in particular. It also is conceivable that the orientation of the axis of the sweeping brushes is adjustable, rendering it possible to switch between the vertical orientation of the axis of the sweeping brushes and the oblique orientation thereof.

The housing of the robotic vacuum cleaner has a front side, which is preferably flat or curved. With respect to the orientation of the plane of the floor, the front side can extend vertically as well as obliquely or curved relative to the plane of the floor.

In principle, any geometric shapes for the base surface of the housing are conceivable without deviating from the scope and spirit of the invention. Base surfaces having curved and straight sections are advantageous, however. Base surfaces that have a combination of straight and curved sections are particularly preferable. Straight sections provide an edge, along which the suction opening can extend. Curved or rounded sections reduce the risk of tipping at corners and improve maneuverability, primarily in narrow spaces. Finally, aesthetic and functional aspects play a role in the design of the housing.

The front side of the housing extends in the transverse direction, i.e., along the width of the housing, while, perpendicularly thereto, a longitudinal direction extends along the length of the housing and parallel to the plane of the floor.\The underside of the housing has a suction opening, which extends in the transverse direction. In an embodiment, an addition to the suction opening, a second suction opening also is disposed on the underside of the housing.

Furthermore, a driving mechanism, which usually has at least two wheels, is disposed on the underside of the housing. The wheels are disposed substantially symmetrically relative to a central axis extending in the longitudinal direction, thereby providing good support and stable driving behavior of the robotic vacuum cleaner. Moreover, further elements for supporting the housing, e.g., runners, can be additionally provided on the underside of the housing. If the wheels are not swivellable in order to permit a steering movement, then an axis of rotation of the wheels is usually parallel to the transverse direction. If the wheels have a synchronous drive in the same direction of rotation, the direction of movement is the longitudinal direction.

The housing of the robotic vacuum cleaner contains an energy source for operating the electric elements, preferably at least one rechargeable battery. An independent, internal energy supply enables the robotic vacuum cleaner to move freely over the surface to be cleaned. In general, it is disadvantageous, however, that rechargeable batteries only provide a limited amount of energy between two charging processes. It is therefore necessary that the available energy be used as efficiently as possible in order to ensure user-friendly operation and the longest possible duration of use.

The intake air flow is induced by an electrically operated fan. The dirt that is picked up is separated from the intake air flow and is collected in the housing, in a container which is suitable therefore, with or without a bag.

In addition, a brush roller is mounted in the suction opening so as to be horizontally rotatable. This brush roller is used to additionally loosen dirt from the floor so that this dirt is captured and carried along by the intake air flow.

Sensors, such as contact sensors, proximity sensors and/or dirt sensors, are mounted on the housing. Contact and/or proximity sensors are already sufficiently known and are used, e.g., as collision protection.

In this context, dirt sensors, which are preferably disposed on the underside of the housing, can measure the condition of the floor as well as the extent of contamination and, on the basis of this information, can adjust the control of the robotic vacuum cleaner to the particular conditions. It is particularly advantageous that the particular current extent of contamination is detected, since this changes over the course of a cleaning process.

The robotic vacuum cleaner also can be used similarly on different floor coverings without additional measures. As a result, the robotic vacuum cleaner is particularly versatile.

An electronic control is provided. All the electric elements of the robotic vacuum cleaner are controlled by the electronic control. This includes, for example, the driving mechanism, the fan, the sweeping brushes, and sensors. A stepiess control is provided for the control of the fan and the sweeping brushes, in particular. Control of the driving mechanism also is provided by which the moving speed is adjusted, for example.

In this context, the electronic control can coordinate the individual elements to be controlled with one another such that optimal cleaning efficiency that is adapted to the particular circumstances is achieved. The electronic control can access information on the surroundings as well as information related to the condition of the floor, the extent of contamination, and the like, wherein said information is provided by the sensors.

If the extent of contamination is high, the moving speed can be reduced. Independently thereof, the output of the fan and/or the rotational speed of the sweeping brushes can be increased in order to achieve greater cleaning performance. If the extent of contamination is low and/or if the floors are easy to clean, e.g., the floors are smooth, the sweeping brushes and/or the fan can be operated in an energy-saving mode, thereby extending the duration of operation between two charging processes. is For carpeted floors, in particular high-pile carpeted floors, an oblique position of the sweeping brushes is advantageous, thereby enabling the bristles of the sweeping brushes to penetrate the fibers of the carpet particularly deeply in order to thereby loosen the dirt from the carpet fibers, and from deeper regions thereof.

Additionally, the driving speed is reduced in the region of walls or other obstacles, in order to clean edge regions particularly carefully.

The electronic control is therefore used to specifically coordinate, on the basis of the information provided, the electric elements of the robotic vacuum cleaner with one another and with the requirements such that an optimal cleaning result and, simultaneously, an efficient use of energy is always achieved.

It also is conceivable, of course, that the sweeping brushes and/or the fan is controlled manually, e.g., by controllers, wherein the controllers are typically mounted on the housing and are designed, e.g., as steplessly controllable rotary controllers.

In order to improve the guidance of the intake air flow, a step also can be provided on the underside of the housing, wherein the front part, in the longitudinal direction, is raised up higher than the floor, as viewed from the floor. The step is used to improve the guidance of the intake air flow toward the suction opening. To this end, it is provided that the step extends in the transverse direction, obliquely toward the front, as viewed from the suction, opening. Preferably, the step extends laterally along the sweeping brushes and/or the step extends along the rear edge of the suction opening, as viewed in the longitudinal direction.

When the step extends laterally along the sweeping brushes, the step also can be disposed at an angle $\alpha$ of 5° and 30° relative to the transverse direction on both sides of the suction opening, wherein a "V" shape therefore results.

The sweeping brushes are rotatably mounted on a vertical or oblique axis such that at least one part of the bristles comes into contact with the floor. There are various alternative embodiments for the embodiment of the sweeping brushes. Initially, the sweeping brushes can be designed such that the bristles extend on a vertical or oblique axis of rotation and on a brush disk disposed perpendicularly thereto, at an oblique angle $\alpha$. Due to the oblique position of the brush disk, a region of the bristles can penetrate the floor particularly deeply, while the opposite part of the bristles is raised off of the floor. Finally, it also is possible that the bristles are disposed substantially on the underside of the brush disk.

The invention also includes an embodiment having two or more suction openings. In this case, it is advantageous when the sweeping brushes are disposed, relative to the transverse direction, not only in the lateral regions of the housing, but also between the suction openings. The direction of rotation of the sweeping brushes is preferably such that all sweeping brushes rotate in the direction of the next-closest suction opening, as viewed from the front side.

BRIEF DESCRIPTION OF THE DRAWINGS

Further features and advantages of the invention will become apparent from the description of embodiments that follows, with reference to the attached figures, wherein.

DETAILED DESCRIPTION OF THE PREFERRED EMBODIMENTS

The following is a detailed description of example embodiments of the invention depicted in the accompanying drawings. The example embodiments are presented in such detail as to clearly communicate the invention and are designed to make such embodiments obvious to a person of ordinary skill in the art. However, the amount of detail offered is not intended to limit the anticipated variations of embodiments; on the contrary, the intention is to cover all modifications, equivalents, and alternatives falling within the spirit and scope of the present invention, as defined by the appended claims.

Figure 1:
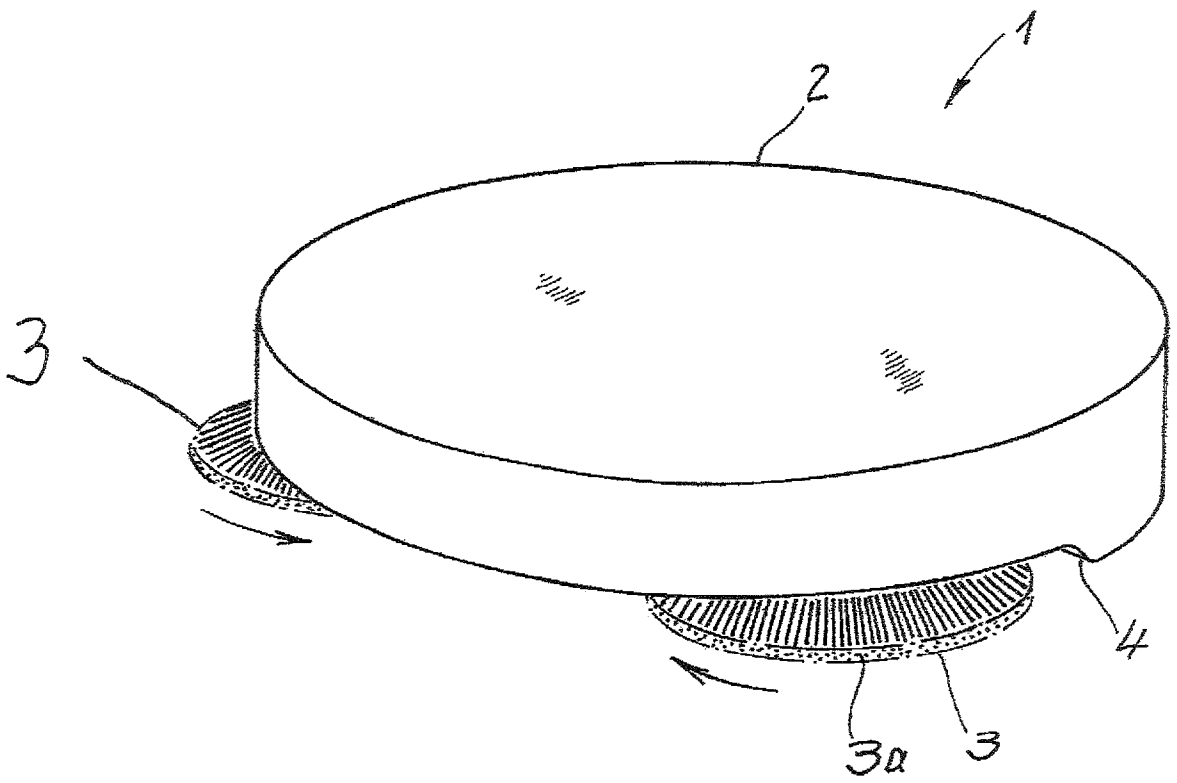
FIG. 1 shows a perspective view of an embodiment of a robotic vacuum cleaner constructed according to the present invention.
Figure 2:
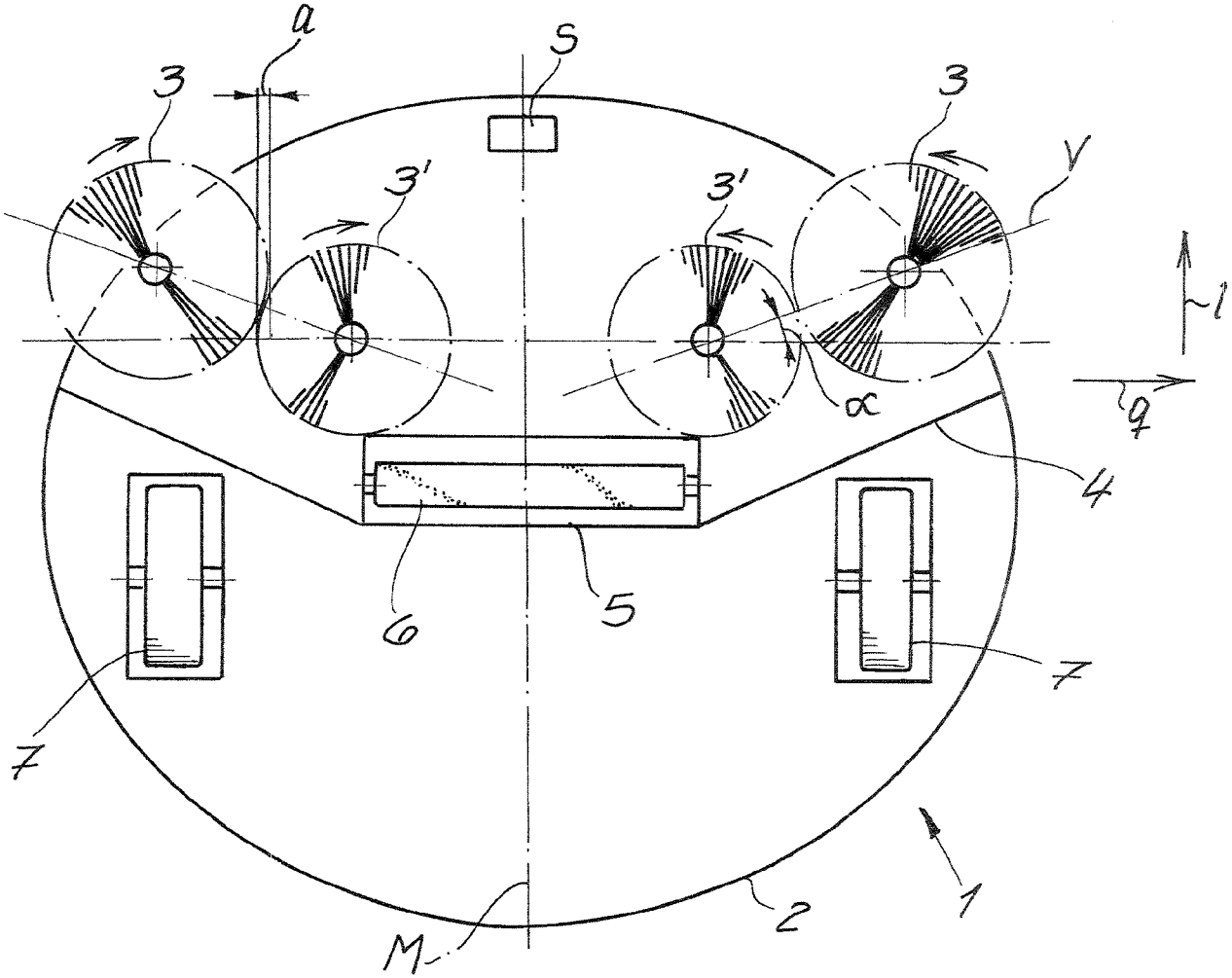
FIG. 2 shows a view of an underside of the robotic vacuum cleaner.

FIG. 1 shows a robotic vacuum cleaner 1 comprising a housing 2, on the underside of which at least two sweeping brushes 3 are disposed on the side and in a front region relative to the longitudinal direction l in each case (see FIG. 2). Bristles 3*a* extend obliquely downward from the brushes in the direction of the floor. Furthermore, a step 4 is visible on the underside of the housing 2, whereby the housing 2 is raised higher off of the floor in the front region relative to the longitudinal axis I.

FIG. 2 shows the FIG. 1 embodiment of the robotic vacuum cleaner 1 in a view from below. Shown therein are a suction opening 5, which extends in the transverse direction q relative the longitudinal axis l and has a horizontal brush roller 6, two wheels 7 that are disposed along the transverse direction q and symmetrically relative to a central axis M extending in the longitudinal direction l, and a total of four sweeping brushes 3, 3'. The sweeping brushes 3, 3' are disposed in pairs symmetrically relative to the central axis M in the front region relative to the longitudinal direction l in each case. Moreover, FIG. 2 highlights shows the step 4, which extends from the rear edge of the suction opening 5 obliquely outwardly and substantially along the boundary of the sweeping brushes 3, 3', as viewed in the longitudinal direction l. Furthermore, a sensor S is provided in the front region on the central axis M.

The outer sweeping brushes 3 extend beyond the edge of the housing 2. The outer sweeping brushes 3 therefore reach outer regions at the sides of the housing 2. The sweeping brushes 3, 3' push the dirt located in front of the robotic vacuum cleaner, relative to the longitudinal direction l, in the direction of the suction opening 5, for the purpose of which the sweeping brushes 3, 3 each rotate in the direction of the central axis M, i.e., in the direction of the suction opening 5, at the forward-pointing ends thereof. The sweeping brushes 3, 3' disposed on one side of the suction opening 5 collectively have a first direction of rotation and the two sweeping brushes 3, 3' disposed on the other side of the suction opening 5 have a second, opposed direction of rotation. Dirt that is captured in an edge region by the outer sweeping brush 3 disposed there is initially pushed, by rotation, in front of the inner sweeping brush 3' and, by bruxh 3' is pushed in front of the suction opening 5.

The inner sweeping brushes 3' partially overlap the width of the suction opening 5, as viewed from the front. A subregion of the suction opening 5 remains free from sweeping brushes 3, 3', however, as viewed from the front. Either the sweeping brushes 3, 3' and/or the suction opening 5 are disposed on the underside along the entire width of the housing 2, as viewed from the front. As a result, the floor that is traversed is cleaned along the entire width of the housing 2.

In order to enable dirt particles to be reliably transported inwardly to the suction opening 5, the inner sweeping brushes 3' are offset slightly to the rear relative to the outer sweeping brushes 3, wherein, in addition, an overlap "a" also is provided in the transverse direction.

As shown, the outer sweeping brushes 3 and the inner sweeping brushes 3' have slightly different diameters. With reference to the two different diameters, the overlap a is in a range between 0.01-fold and 0.3-fold the smaller and the larger diameter, respectively, of the sweeping brushes 3, 3'.

Since the inner sweeping brushes 3' are offset slightly to the rear, a connecting line V extends between the sweeping brushes 3, 3', which are assigned to one another in each case, obliquely inwardly in the direction toward the central axis M and the suction opening 5. The angle $\alpha$ of the connecting line V is preferably between 5° and 30° relative to the transverse direction q.

The previously described step 4 extends approximately parallel to the connecting line V.

Since a majority of the width of the robotic vacuum cleaner is covered in the transverse direction q by the sweeping brushes 3, 3', the suction opening 5 can have a relatively small width. In particular, the suction opening 5 extends across less than half the width of the housing 2, in the transverse direction q.

Figure 3:
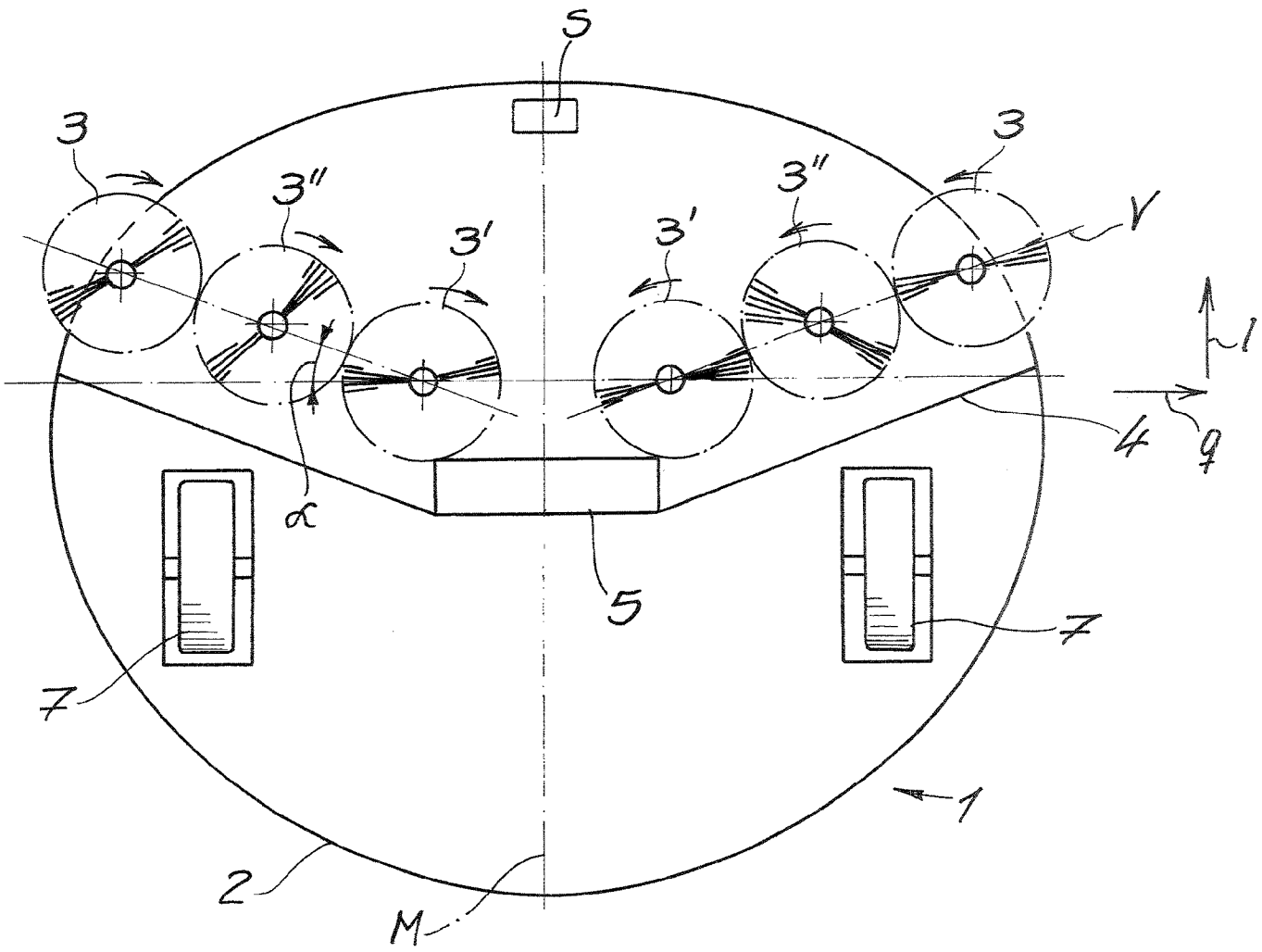
FIG. 3 shows an alternative embodiment of the FIG. 1 robotic vacuum cleaner, including six sweeping brushes and without a horizontal brush roller.

FIG. 3 shows an alternative embodiment of a robotic vacuum cleaner 1, in a view from below, having six sweeping brushes 3, 3', 3". Each of the three sweeping brushes 3, 3', 3" is disposed in laterally opposed regions relative to the central axis M. As described above with reference to FIG. 2, two wheels 7, one sensor A, and a step 4 are provided. Since six sweeping brushes 3, 3', 3" are used, the suction opening 5 can have a particularly small width as compared to the width of the housing 2.

The three sweeping brushes 3, 3', 3" disposed on each side of the suction opening are disposed along a common connecting line V.

Figure 4:
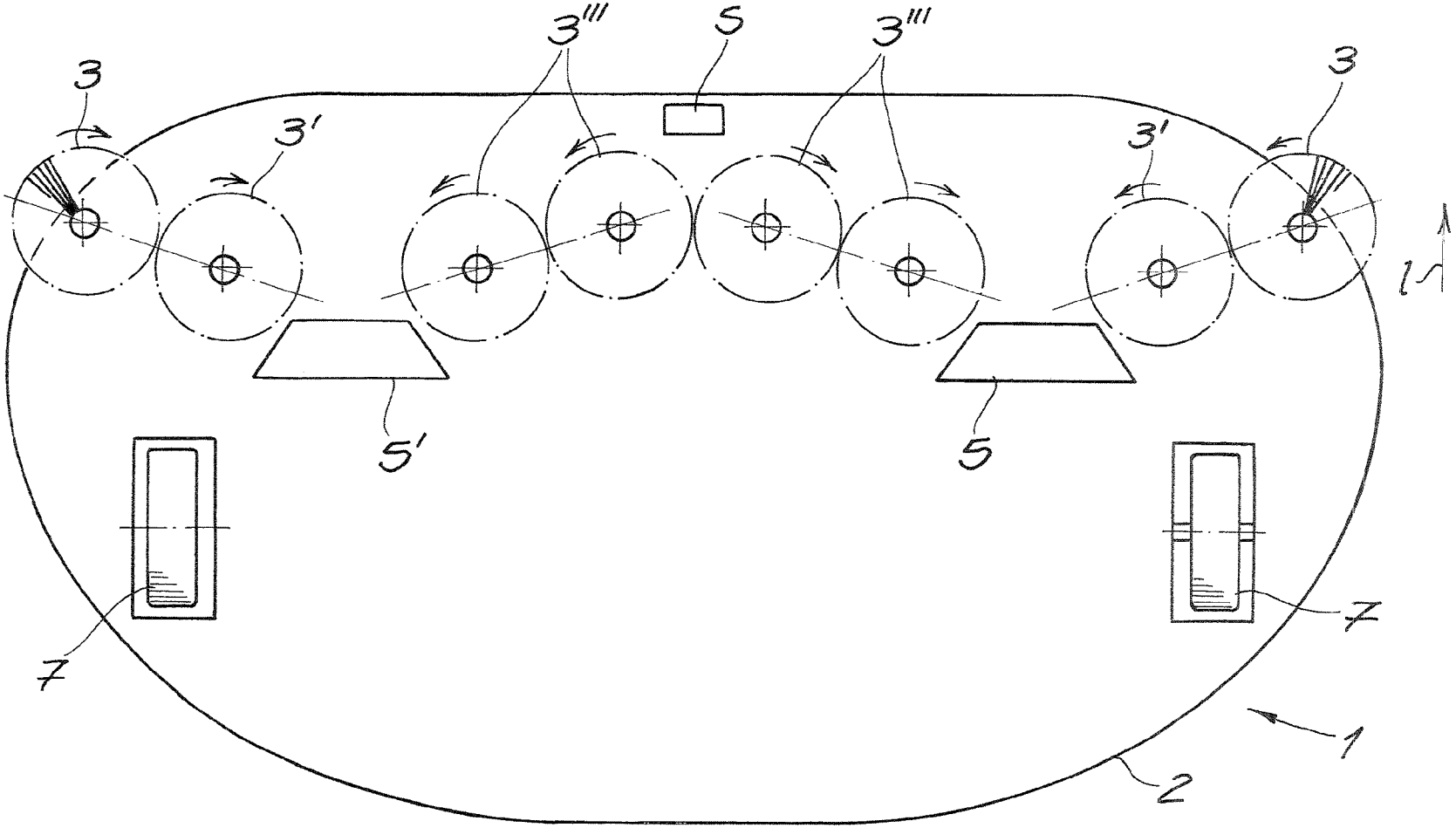
FIG. 4 shows a further alternative embodiment of the robotic vacuum cleaner, which comprises two suction openings and sweeping brushes disposed in the transverse direction between the suction openings.

FIG. 4 shows yet another alternative embodiment of a robotic vacuum cleaner 1, wherein two suction openings 5, 5' are disposed on the underside of the housing 2,. In order to capture dirt located in front of the robotic vacuum cleaner 1, as viewed in the longitudinal direction l, between the two suction openings 5, 5', sweeping brushes 3" are disposed between the suction openings, wherein said sweeping brushes sweep the dirt in the direction of the particular suction opening 5 or 5' that is closer. The small width of the two suction openings 5, 5' as compared to the overall width of the housing 2 is advantageous in this case. Moreover, as in FIGS. 2 and 3, two wheels 7, sweeping brushes 3, 3', and a sensor S are disposed on the underside of the housing 2.

The sweeping brushes 3, 3', 3", each of which rotates via the front edge thereof in the direction of the closest suction opening 5, 5', are disposed in the shape of a "W" s in the embodiment according to FIG. 4.

Figure 5A:
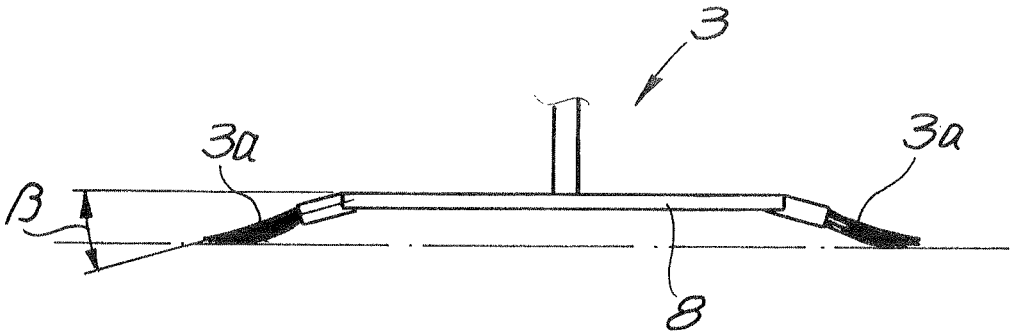
FIG. 5A show one form of the sweeping brushes of the inventive robotic vacuum cleaner.
Figure 5B:
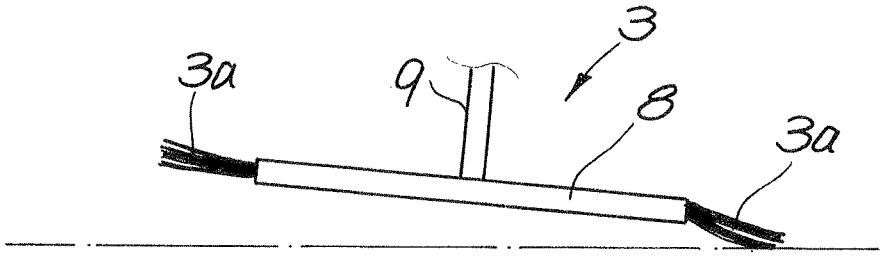
FIG. 5B show another form of the sweeping brushes of the inventive robotic vacuum cleaner.
Figure 5C:
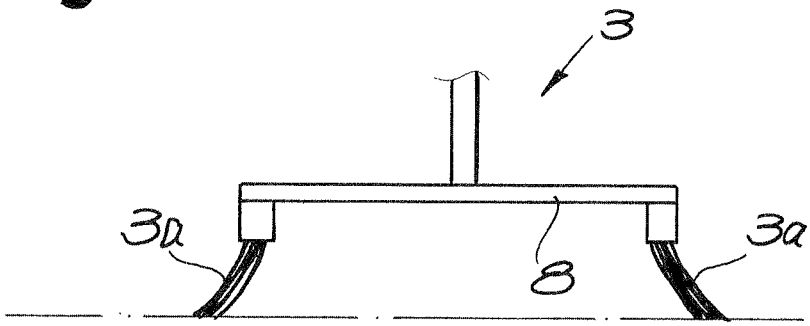
FIG. 5C show yet another form of the sweeping brushes of the inventive robotic vacuum cleaner.

FIGS. 5A-C each show alternative embodiments of the sweeping brushes 3. That is, FIG. 5A shows an embodiment of the sweeping brushes 3 in which the bristles 3*a* are mounted on the brush disk 8 at an oblique angle $\beta$.

FIG. 5B shows an embodiment of the sweeping brushes 3 having an obliquely extending axis of rotation 9, a brush disk 8 vertically positioned thereon, and bristles 3*a* protruding therefrom in a straight line. FIG. 5*c* shows an embodiment of a sweeping brush 3, wherein the bristles 3*a* are mounted on the underside of the sweeping disk 8.

As will be evident to persons skilled in the art, the foregoing detailed description and figures are presented as examples of the invention, and that variations are contemplated that do not depart from the fair scope of the teachings and descriptions set forth in this disclosure. The foregoing is not intended to limit what has been invented, except to the extent that the following claims so limit that.

What is claimed is:

1. A robotic vacuum cleaner, comprising:

a driving mechanism;

a fan;

an electronic control;

at least four sweeping brushes; and a housing having a front side extending in a transverse direction (q), having a longitudinal direction (I) perpendicular to the transverse direction (q), and having an underside with a first suction opening that extends in the transverse direction (q);

wherein at least two of the four sweeping brushes are provided on each side of the first suction opening and at least one subregion of the first suction opening remains free from sweeping brushes, as viewed from the front side; and wherein said at least two of the four sweeping brushes provided on side of the first suction opening are driven in an identical direction of rotation; and wherein on both sides of the first suction opening, a connecting line (V) between axes of rotation of said at least two of the four sweeping brushes disposed there in succession points in the direction of the first suction opening.

2. The robotic vacuum cleaner according to claim 1, wherein the first suction opening extends in the transverse direction (q) across less than half an entire width of the housing.

3. The robotic vacuum cleaner according to claim 1, wherein the axes of rotation of the at least four weeping brushes are oriented vertically or obliquely relative to a horizontal line and wherein the axes of rotation of the at least four weeping brushes are disposed in front of the first suction opening as viewed in the longitudinal direction (I).

4. The robotic vacuum cleaner according to claim 1, wherein one of the at least four sweeping brushes protrudes on at least one side of the housing.

5. The robotic vacuum cleaner according to claim 1, wherein the connecting lines (V) on both sides of the first suction opening are disposed at an angle ($\alpha$) between 5° and 30° relative to the transverse direction (q), as viewed from above.

6. The robotic vacuum cleaner according to claim 1, wherein the at least four sweeping brushes have a diameter in a plane formed by the longitudinal direction (I) and the transverse direction (q) and wherein the at least four sweeping brushes that are directly adjacent to one another have an overlap in the transverse direction (q) that is between 0.01-fold and 0.3-fold the diameter.

7. The robotic vacuum cleaner according to claim 1, wherein a horizontally rotatable brush roller is disposed in the first suction opening.

8. The robotic vacuum cleaner according to claim 1, wherein at least one step is provided on the underside of the housing.

9. The robotic vacuum cleaner according to claim 1, wherein a second suction opening is disposed on the underside of the housing.

10. The robotic vacuum cleaner according to claim 9, wherein the at least four sweeping brushes are disposed in the transverse direction (q) between the first suction opening and the second suction opening.

* * * * *